United States Patent [19]

Ibsen

[11] Patent Number: 4,502,550

[45] Date of Patent: Mar. 5, 1985

[54] MODULAR THROUGH-TUBING CASING GUN

[75] Inventor: Barrie G. Ibsen, Nacogdoches, Tex.

[73] Assignee: Magnum Jet, Inc., Cut Bank, Mont.

[21] Appl. No.: 446,999

[22] Filed: Dec. 6, 1982

[51] Int. Cl.[3] ..... E21B 43/117

[52] U.S. Cl. ..... 175/4.6; 166/297

[58] Field of Search ..... 175/2, 4.6, 4.51; 166/117, 235, 297; 102/317, 319

[56] References Cited

U.S. PATENT DOCUMENTS

| | | | |
|---|---|---|---|
| 949,778 | 2/1910 | Pringle | 102/317 |
| 2,749,840 | 6/1956 | Babcock | 175/4.6 |
| 2,766,828 | 10/1956 | Rachford, Jr. | 166/36 |
| 2,947,251 | 8/1960 | Jilly | 175/4.6 |
| 3,207,072 | 9/1965 | Holden | 102/24 |
| 3,234,875 | 2/1966 | Tolson | 102/24 |
| 3,238,872 | 3/1966 | Zernow et al. | 102/20 |
| 3,244,101 | 4/1966 | Bell | 102/20 |
| 3,259,064 | 7/1966 | Owens | 102/24 |
| 3,268,016 | 4/1966 | Bell | 175/4.51 |
| 3,276,369 | 10/1966 | Bell | 175/4.6 |
| 3,302,567 | 2/1967 | Venghiattis | 102/24 |
| 3,419,070 | 12/1968 | Ernst | 166/5 |
| 3,517,745 | 6/1970 | Suman, Jr. | 166/297 |
| 3,530,948 | 9/1970 | Garret | 175/4.51 |
| 3,627,045 | 12/1971 | Lebourg | 166/278 |
| 3,659,658 | 5/1972 | Brieger | 175/4.6 |
| 4,179,991 | 12/1979 | Echols | 175/4.6 |
| 4,253,523 | 3/1981 | Ibsen | 166/299 |

*Primary Examiner*—George A. Suchfield
*Assistant Examiner*—Michael Starinsky
*Attorney, Agent, or Firm*—Glaser, Griggs & Schwartz

[57] ABSTRACT

A novel and improved form of through-tubing perforating assembly conformable for use in various types of cased well bores having particular application in those in which a tubing string is positioned within the cased well bore and where extremely high pressures are encountered at the bottom of the well. A plurality of shaped charges are mounted in a modular carrier comprised of a plurality of generally tubular members interconnected in end-to-end relation to one another, each tubular member having an internal cavity defining a horizontally directed seating portion for supporting one of the shaped charges therein. An end cap is disposed at the lower end of the modular carrier, and a blasting cord extends continuously through the tubular members across one end of the shaped charges for detonating the charges when positioned opposite to that part of the formation to be perforated.

15 Claims, 6 Drawing Figures

MODULAR THROUGH-TUBING CASING GUN

This invention relates to perforating devices adapted for use in oil and gas wells; and more particularly relates to a novel and improved modular through-tubing casing gun for use in perforating cased well bores beneath a tubing string.

BACKGROUND AND FIELD OF THE INVENTION

In oil and gas perforating operations, much greater penetration is achieved in casing gun assemblies than the through-tubing units. In particular, the through-tubing units presently in use may contain the same amount of charge as casing guns but have not been able to penetrate as deeply into the formation owing to their wider cone angle and limitations in overall size imposed by the inner concentric tubing strings through which they are deployed. The through-tubing devices are principally employed where high pressure and well conditions are such that perforating with casing gun assemblies is not practical. Typical of the casing gun types of perforating assemblies are those disclosed in prior U.S. Pat. No. 4,253,523 and prior pending patent application, U.S. Ser. No. 299,479, filed Sept. 4, 1981, now U.S. Pat. No. 4,467,878 for SHAPED CHARGE AND CARRIER ASSEMBLY THEREFOR.

It is now proposed to provide a through-tubing perforating assembly capable of achieving much greater penetration and specifically in such a way as to be able to employ standard casing gun charges possessing the desired penetrating configuration while withstanding high pressure conditions; yet can be passed through relatively small diameter tubing to the desired zone or formation to be perforated.

Representative U.S. Letter Patents disclosing through-tubing perforating apparatus are U.S. Pat. Nos. 2,746,828 to H. H. Rachford, Jr.; 3,207,072 to J. R. Holden; 3,234,875 to E. O. Tolson; 3,238,872 to L. Zernow et al; 3,244,101 and 3,268,016 to W. T. Bell; 3,259,064 to N. G. Owens; 3,302,567 to A. A. Venghiattis; 3,419,070 to E. A. Ernst; 3,517,745 to G. O. Suman, Jr.; and 3,627,045 to M. P. Lebourg.

SUMMARY OF THE INVENTION

It is therefore an object of the present invention to provide for a novel and improved perforating assembly adaptable for use in perforating subsurface oil and gas subsurface formations which is versatile and of simplified construction.

It is another object to provide for a novel and improved form of perforating assembly which is capable of perforating either through casing or tubing and which is capable of using shaped charges normally employed in casing guns.

Another object of the present invention is to provide for a through-tubing perforating assembly which employs casing gun charges to achieve narrow cone angles with much greater penetration than heretofore possible and permits disposition in phase or out of phase through an adjustable length carrier containing the desired number of charges.

It is a still further object of the present invention to provide for a through-tubing perforating assembly which can be made up of the desired number of casing gun charges disposed either in centered or off-center relationship within a casing and capable of withstanding extremely high pressures at the bottom of a well.

It is an additional object of the present invention to provide in a perforating assembly for novel and improved modular high-strength sections for mounting and support of a series of shaped charges either in phase or in out of phase relation to one another.

In accordance with the present invention, there has been devised a novel and improved form of through-tubing perforating assembly conformable for use in various types of cased well bores but having particular application in those in which a tubing string is positioned within the cased well bore and where extremely high pressures are encountered at the bottom of the well. In the preferred form of assembly, a plurality of shaped charges of the casing gun type are mounted in a modular carrier wherein the carrier comprises a plurality of generally tubular members interconnected in end-to-end relation to one another, each tubular member having an internal cavity defining a horizontally directed seating portion for supporting one of the shaped charges therein. An end cap is disposed at the lower end of the modular carrier, and a blasting cord extends continuously through the tubular members across one end of the shaped charges for detonating the charges when positioned opposite to that part of the formation to be perforated. Each of the tubular members is characterized in particular by the mounting and disposition of the shaped charges such that they can be cradled or supported within the tubular member and anchored in place by interconnection of each next tubular member in succession without the use of separate fastening elements. The desired number of charges and tubular members can be interconnected in end-to-end relation with the blasting cord extending through grooved portions passing across slotted ends of each of the shaped charges so that when the tubular members are made up together the shaped charge in each tubular member is caused to bear firmly against the blasting cord at its slotted end to assure detonation of the charge when the blasting cord is ignited. The tubular members are such that they can be aligned with their respective charges extending either in phase or in 180° out of phase relation to one another and suspended downwardly through an inner tubing string to the desired depth. The charges may be placed either in centered relation to the cased wall bore or in off-center relation and may be suspended by various well-known means, such as, a wireline tool.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 3:
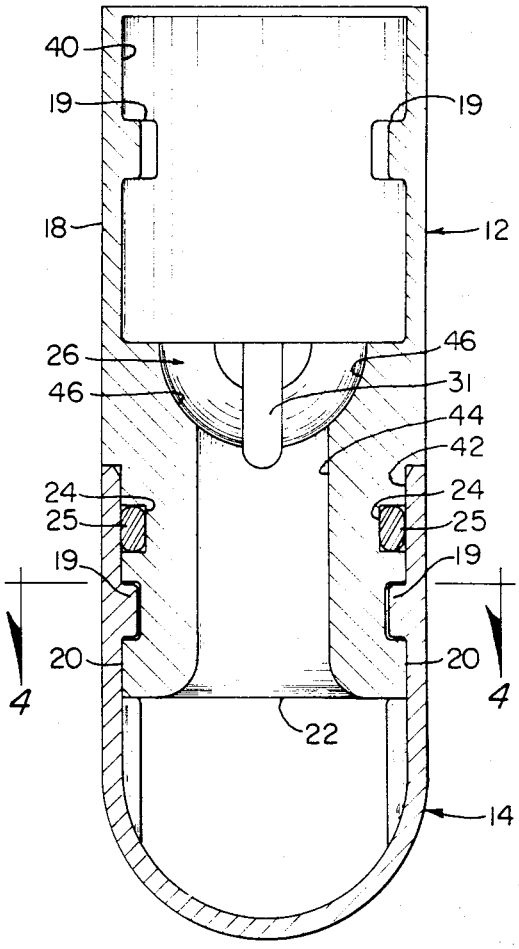
FIG. 3 is a cross-sectional view taken about lines 3—3 of FIG. 2.
Figure 4:
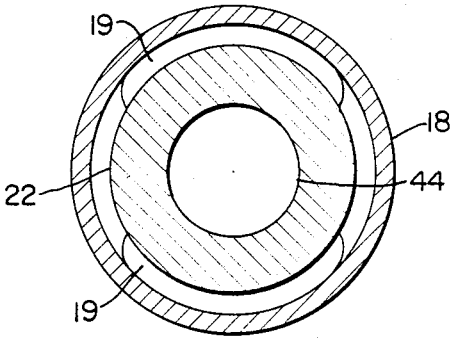
FIG. 4 is a cross-sectional view taken about lines 4—4 of FIG. 3.
Figure 5:
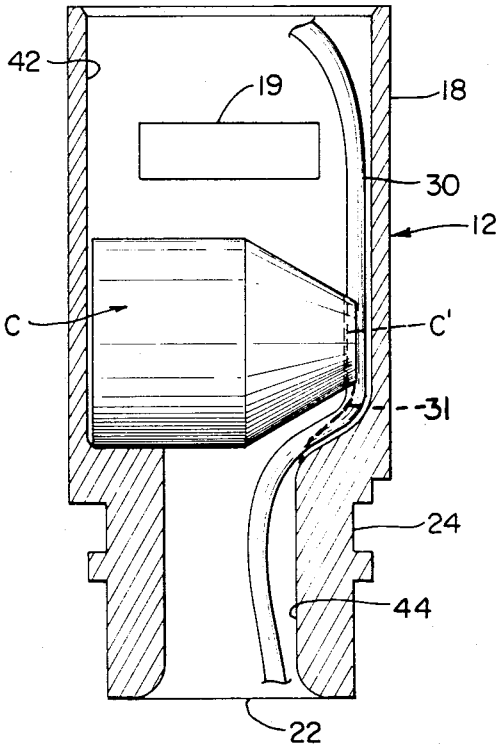
FIG. 5 is a cross-sectional view taken about lines 5—5 of FIG. 2.

A preferred form of perforating assembly 10 is comprised of a plurality of tubular modules 12 interconnected in end-to-end relation to one another and terminating at their lower end in a nose cone 14 and at their upper end in a tubing support connector 16. The tubular modules 12 as well as nose cone 14 have upwardly directed socket ends, for example, as illustrated at 18 in FIG. 3 with diametrically opposed internal locking dogs or teeth 19 adapted to interengage with external locking dogs or teeth 20 at the lower end of each module 12 as well as the lower end of the upper support connector 16. Thus, each lower complementary end 22, as shown in FIGS. 3, 4 and 5, is of a reduced external diameter slightly less than the diameter of the internal wall surface of the upper socket ends 18 and is provided with diametrically opposed dogs 20 which are advanced past the diametrically opposed internal locking dogs 19 then rotated into locking engagement behind the dogs as shown in FIG. 3. A circumferential groove 24 is spaced above the locking dogs 20 to accommodate an O-ring seal 25 which effects sealed engagement between the reduced lower end 22 and upper socket end 18 of each of the modules when interconnected in end-to-end relation to one another.

Figure 1:
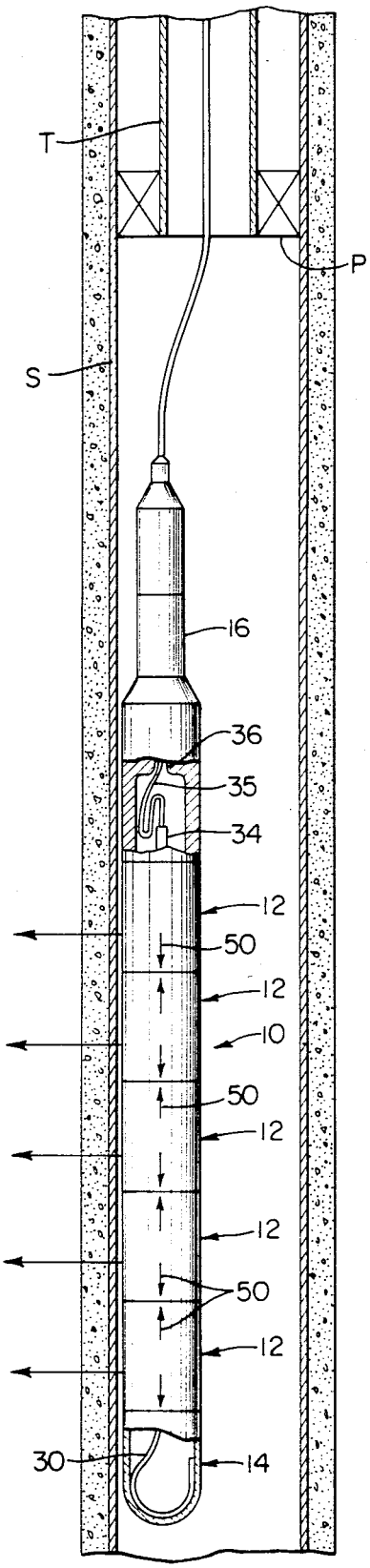
FIG. 1 is a view partially in section illustrating the disposition of a preferred form of perforating assembly in off-center relation to a casing opposite to the zone in a subsurface formation to be penetrated.
Figure 2:
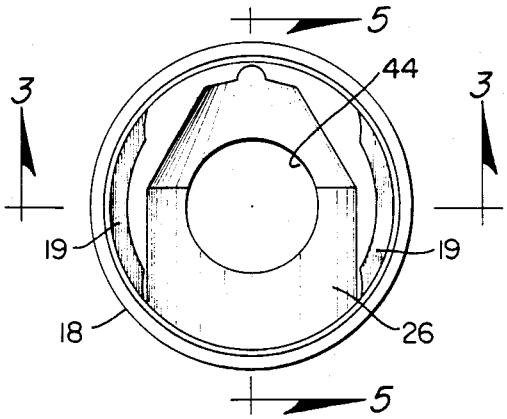
FIG. 2 is an end view of one of the modules comprising the preferred form of perforating assembly of the present invention.
Figure 6:
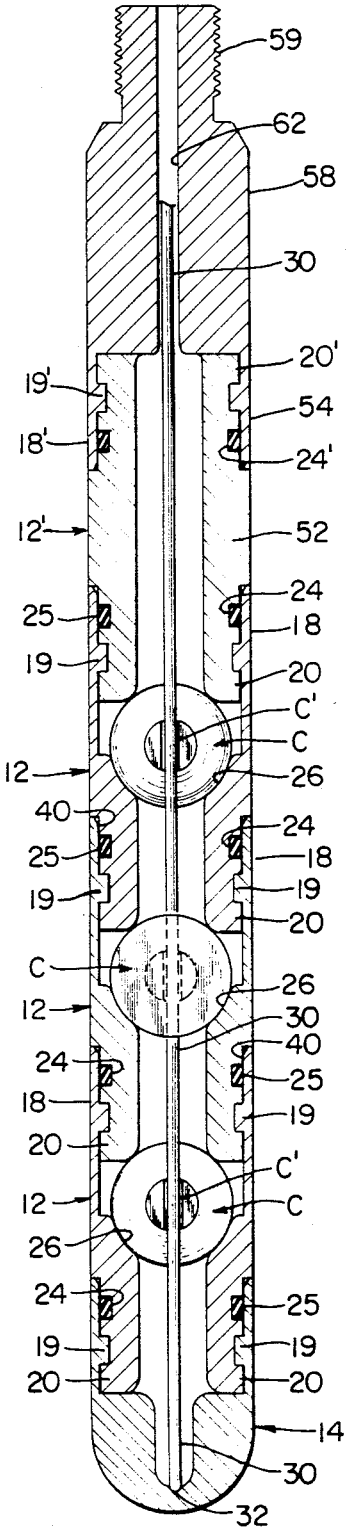
FIG. 6 is a vertical section view of the preferred form of perforating assembly aligned for use in centered relation to a casing in accordance with the present invention.

Each of the tubular modules 12 is provided intermediately of its upper and lower ends with an internal cavity defining a horizontally disposed cradle or support 26 for horizontal disposition of a shaped charge C, as illustrated in FIGS. 5 and 6. A Prima cord 30 is passed downwardly through the entire assembly of modules from the upper support connector 16 and through vertically extending slots 31 disposed at the ends of the supports 26 in the modules so as to position the Prima cord at the nose end of the shaped charges C positioned therein. The lower extreme end of the Prima cord 30 is inserted into an arcuate groove 32 located internally of the lower extremity of the nose cone 14. As shown in FIG. 1, the upper end of the Prima cord 30 is secured to a blasting cap 34 in a conventional manner, the cap 34 having leads 35 passing upwardly through a central passage 36 in the upper support connector 16 for connection to a wireline tool in a manner hereinafter described. In this relation, the Prima cord 30 is preferably of rectangular cross-section.

Considering in more detail the construction of each modular tubing section 12, each is correspondingly formed with a thin-walled socket end 18 having an inner wall surface 40 of a diameter to permit insertion of the external wall surface 42 of the male end of the next module. As described, the external diameter of the male end is reduced by an amount corresponding to the thickness of the socket end 18 and is relatively thick-walled with an inner wall surface 44 forming a central passage in communication with the socket end 18. The cradle support 26 is formed at the upper end of the passage 44 by arcuate recessed portions 46 in diametrically opposed sides of the inner wall surface and which together form a generally semi-cylindrical, horizontal support for the lower half of the shaped charge C.

As seen from FIG. 6, an upper tubing adaptor module 12' is comprised of a hollow cylindrical body 52 having a lower end 20 corresponding to the male end 20 of modular sections 12 together with an oppositely directed male end 20' which corresponds to the male end 20 but is provided with one or more circumferential grooves 24' to facilitate interlocking sealed connection to lower socket end 54 on the tubing support connector 16. The support connector 16 also is of tubular construction having a lower socket end 18' provided with diametrically opposed internal locking dogs 19'. The support connector tapers rearwardly as at 58 into a threaded end portion 59 to facilitate interconnection to a wireline tool, not shown, in a well-known manner. A central passage 62 extends through the support connector 16 into communication with the socket end 18' to permit extension of the connecting wires or leads from the wireline tool. Preferably, the support connector 16 is composed of a high strength metal which will not be damaged when the charges C are detonated so that the connector can be retrieved along with the wireline tool. However, the modules 12 are preferably composed of a ceramic material of sufficiently high strength to withstand substantial pressures downhole but which will be completely disintegrated by the detonation of the charges.

In practice, the modules 12 are assembled first by positioning the lower end of the Prima cord 30 in the slot 32 formed in the interior of the end cap 14, followed by interconnection of the first module 12 to the end cap 14. The Prima cord 30 is passed upwardly through the module 12 and inserted into the slot 31 prior to placement of a shaped charge C on the cradle 26 within the module. A slotted end C' of the charge C is aligned with the slot 31 so as to sandwich the Prima cord 30 therebetween. A second module 12 is then interlocked as described with the first module, the lower edge of the second module bearing lightly against the upper surface of the charge C so as to securely retain the charge in position within the first module. A series of modules 12 are successively assembled in the manner described with respect to the first and second modules in accordance with the number of charges C to be employed. For the purpose of illustration, the number of charges may vary over a wide range with each charge containing from 6 grams to 22 grams of explosive. The specific makeup of the charges, as such, forms no part of the present invention. However, of particular importance is the fact that the modular carrier is so constructed as to permit use of casing gun charges, such as, those of the type disclosed in my hereinbefore referred to U.S. Pat. No. 4,253,523 and pending patent application.

Alignment markings or arrows 50 on the external surfaces of the modules 12 will assure exact alignment of the charges C within the modules so that the charges can be directed precisely in the same direction or with adjacent charge positioned at 180° to one another throughout the assembly; i.e., the charges can be disposed either in phase or in out of phase relation to one another depending upon the specific application of the assembly. In FIG. 1, assembly 10 is shown suspended in off-center relation to a casing S which is cemented in a well bore. The tubing string T is sealed off at its lower end by a packer P above the section of the casing to be perforated, but imposes definite limitations on the size or diameter of the assembly 10, since it must be lowered through the tubing string. In the application shown in FIG. 6, where it is desired to maintain the assembly 10 in centered relation to a casing, suitable centralizers are employed between the assembly 10 and the wireline which will expand into engagement with the casing and maintain the assembly 10 in the center of the casing. In such applications, it is desirable to position the charges C in out-of-phase relation to one another in order to penetrate through diametrically opposed sides of the casing and into the formation.

From the foregoing, it will be readily appreciated by those skilled in the art that the through-tubing perforating assembly of the present invention offers the ability to enhance production capabilities on new and old wells. For instance, in deep wells where high pressure and temperature can complicate completion, the present invention offers the ability to maximize perforation performance for operations of up to 25,000 psi at 650° F.; or, where formation characteristics dictate multiple zone completion, it offers maximized perforation performance. Moreover, where perforation characteristics dictate massive interval completion, the present invention offers the ability to perforate at whatever shot density is desired and over the desired interval by making repeated runs. A modular perforating assembly of the type described further eliminates downhole obstruction below the tubing, which in some cases eliminates the possibility and avoids the necessity of workover procedures, such as, zone isolation. In large diameter holes completed through-tubing, the modular perforating assembly of the present invention offers the ability to use the same charges with the same perforation performance as normally would be expected using a hollow steel carrier gun in casing applications.

Accordingly, the present invention offers a total expendible, acid-resistant ceramic carrier for use with powdered metal-shaped charges for debris-free completion. As a result, it is readily conformable for use with any superior shaped-charge technology with the added advantage of offering maximum perforation performance unaffected by high pressure and temperature conditions.

Thus, while there has been described a preferred embodiment of the present invention, it is to be understood that various modifications and changes may be made as will be apparent to those skilled in the art without departing from the spirit and scope of the present invention as defined by the appended claims.

I claim:

1. In a perforating assembly adapted for use in a cased well bore, the combination comprising:

a plurality of shaped charges;

an elongated modular carrier comprising a plurality of charge-supporting, generally tubular modules interconnected in end-to-end relation to one another, each said tubular module having an integrally formed end inserted through an end of each next tubular module for releasable engagement directly therewith, each said tubular module having an inner passage and an inner wall portion projecting inwardly into said inner passage defining an arcuate horizontally disposed cradle for supporting one of said shaped charges thereon, said one of said shaped charges supported on said cradle to extend transversely across said passage, each of said charges being secured in each of said tubular modules by said cradle and by said integrally formed end of the adjacent tubular module in contact with a surface of said shaped charge diametrically opposite said cradle; and a blasting cord extending across one end of each of said shaped charges.

2. In the assembly according to claim 1, the lower end of each said tubular module inserted through the upper end of each next tubular module and in close-fitting relation to the upper surface of the shaped charge positioned in each said next tubular module.

3. In the assembly according to claim 1, each of said tubular modules having complementary, releasable connecting means to interconnect said tubular modules in end-to-end relation to one another, said interconnecting means defined by interengaging dogs on the external surface of one end of each said tubular module and on the internal surface of an opposite end of each tubular module.

4. In the assembly according to claim 3, said interengaging dogs being in the form of circumferentially spaced ribs.

5. In the assembly according to claim 4, said ribs at the one end of said tubular modules positioned to extend beyond the ribs on the opposite end of each said tubular module and rotatable into alignment whereby to releasably lock said tubular modules together.

6. In the assembly according to claim 1, each of said tubular modules composed of a thick-walled ceramic material.

7. In the assembly according to claim 1, each of said tubular modules including longitudinally extending grooves along an interior wall surface of each said tubular module to permit insertion of said blasting cord therein.

8. In the assembly according to claim 1, each said tubular module having a reduced lower end for insertion into an upper end of each next tubular module in succession.

9. In the assembly according to claim 8, said tubular modules interconnected to define an exterior uninterrupted outer cylindrical surface of uniform diameter.

10. In the assembly according to claim 1, including alignment means on the exterior surfaces of said tubular modules to establish a predetermined phase relationship between the shaped charges therein.

11. A through-tubing perforating assembly adapted for use in a cased well bore having an inner concentric tubing string, the combination comprising:

a plurality of shaped charges; and an elongated modular carrier sized for insertion through said tubing string comprising a plurality of charge-supporting, generally tubular members interconnected in end-to-end relation to one another, each said tubular member having an internal diameter dimensioned for insertion of a shaped charge therein and including an internal wall portion of increased thickness defining an arcuate horizontally disposed cradle for supporting one of said shaped charges thereon, each of said tubular members having an integrally formed end inserted through an integrally formed end of each next tubular member for releasable engagement directly therewith and disposed in contact with a surface of the shaped charge diametrically opposite to said cradle, and a lower cap interconnected to a lower end of said carrier.

12. The assembly according to claim 11, each of said tubular members having complementary, releasable connecting means to interconnect said tubular members in end-to-end relation to one another, said interconnecting means defined by interengaging ribs on the external surface of one end of each said tubular member and on the internal surface of an opposite end of each tubular member.

13. The assembly according to claim 12, said interengaging ribs being circumferentially spaced, said ribs at the one end of said tubular member positioned to extend past the ribs on the opposite end of each said tubular member and rotatable into alignment whereby to relasably lock said tubular members together.

14. In the assembly according to claim 11, each of said tubular members composed of a thick-walled ceramic material including longitudinally extending grooves along an interior wall surface of each said tubular member, and a blasting cord inserted into said grooves.

15. The assembly according to claim 14, each said tubular member having a reduced lower end for insertion into an upper end of each next tubular member in succession, and said tubular members interconnected to define an exterior uninterrupted outer cylindrical surface of uniform diameter.

* * * * *